United States Patent [19]

Schneiter

[11] Patent Number: 4,668,895

[45] Date of Patent: May 26, 1987

[54] DRIVING ARRANGEMENT FOR A VARYING COLOR LIGHT EMITTING ELEMENT

[75] Inventor: Werner Schneiter, Bienne, Switzerland

[73] Assignee: Omega Electronics S.A., Bienne, Switzerland

[21] Appl. No.: 840,258

[22] Filed: Mar. 17, 1986

[30] Foreign Application Priority Data

Mar. 18, 1985 [FR] France ..... 85 04085

[51] Int. Cl.[4] ..... H05B 37/02

[52] U.S. Cl. ..... 315/158; 315/156; 315/200 R; 362/811

[58] Field of Search ..... 315/154, 158, 200 R, 315/149, 156; 362/811

[56] References Cited

U.S. PATENT DOCUMENTS

| | | | |
|---|---|---|---|
| 3,222,574 | 12/1965 | Silvestri | 315/200 R |
| 3,789,211 | 1/1974 | Kramer | 362/811 |
| 3,805,049 | 4/1974 | Frank et al. | 362/811 |
| 4,358,754 | 11/1982 | Young et al. | 362/811 |

*Primary Examiner*—Harold Dixon

*Attorney, Agent, or Firm*—Griffin, Branigan, & Butler

[57] ABSTRACT

This light emitting element comprises three differently colored luminous sources the excitation of which varies as a function of a signal developed by a physical phenomenon sensor, in particular a microphone. The analog signal emitted by the sensor is initially converted into a sequence of electrical pulses in a suitable converter. The leading edges of said pulses are next applied to a counter the output of which provides a coded signal which changes with the arrival of each such edge and thus determines a different state of excitation of the luminous sources. The arrangement as described enables changing the color of the element from a musical signal.

8 Claims, 7 Drawing Figures

DRIVING ARRANGEMENT FOR A VARYING COLOR LIGHT EMITTING ELEMENT

This invention concerns a driving arrangement for a light emitting element provided with at least two radiating luminous sources each having a different primary colour, the colour gradation emitted by said element changing as a function of the variations of an electrical analog signal provided by a physical phenomenon sensor in particular a microphone.

BACKGROUND OF THE INVENTION

Light emitting elements having several luminous sources of different colours are already known. The French patent document No. FR-A-2 186 624 provides a set of three luminous sources of different colours combined with a reflector to assure mixing of the colours. In order to individually vary the luminous intensity of each of these sources, there is employed a strip of paper provided with three tracks the transparency of which varies as a function of the illumination to be furnished at each instant by each luminous source. The transparency is measured by photo-electric cells in a manner such that when the strip moves the resulting colour gradation emitted by the reflector varies. U.S. Pat. No. 3,364,332 describes a system similar to that which has just been mentioned in which the controlling element for changing the colour gradation is in the form of a disc turning in a continuous manner.

Furthermore, it has already been suggested to control the intensity of light from a luminous source by means of a musical signal derived from a microphone or a recording placed on a support, e.g. a magnetic tape or a record. U.S. Pat. No. 3,222,574 describes such a system in which the musical signal is initially divided into three frequency bands and where the signals thus filtered are each applied to a separate lamp of which the first reacts to high frequencies, the second to medium frequencies and the third to low frequencies. These systems are presently used in recreational electronics and applied at home or in discothèques.

Arrangements based on frequency discrimination generally also cause the luminous intensity to depend generally from the sonic volume. They exhibit however several difficulties. Initially, if one is concerned with a sound source having a limited pass band (for instance radio using amplitude modulation) the corresponding luminous gradation will exhibit a dominant colour imposed by the filter systems. If red is chosen for low frequency, green for medium frequency and blue for high frequencies, the colour gradation given by the sound of the radio in AM is located almost entirely in the red and the green as well as the mixture of these two colours. In the same manner, a rhythmic recording of which the cadence is given by contrabass chords produces almost the same effect. In these cases, the blue will be almost totally absent from the light palette. One might also cite examples in which the sonic register is carried towards high frequencies or extremely high frequencies in which case it would be the red which would appear rarely or never. Finally, it is necessary to indicate that all the systems which are proposed today exhibit a luminous intensity which varies as a function of the volume of the sound. This provokes the difficulty of having to proceed with an adjustment of the sensitivity when one goes from one source of sound (lightly recorded) to another (heavily recorded). Finally, the systems proposed show during musical silences or during soft passages of the music, undesirable "black" states.

SUMMARY OF THE INVENTION

With the purpose of overcoming the difficulties hereinbefore mentioned, this invention provides a driving arrangement for a light emitting element having at least two luminous sources each adapted to emit a different primary colour, the colour gradation emitted by said element changing as a function of an electrical analog signal provided by a physical phenomenon sensor, in particular a microphone, comprising a converter adapted to convert said analog signal into a sequence of electrical pulses the leading anc trailing edges of which succeed one another at a rhythm which depends on the variations of said analog signal and a counter utilising the leading and trailing edges of each of said pulses to provide a coded signal at its output the state of which changes each time one of said leading or trailing edges is applied thereto, each of said states of said coded signal giving rise to a predetermined state of excitation of said luminous sources.

Thus an important purpose which the present invention fulfils is to have the illumination of the luminous sources depend not from the frequency or from the level of an analog signal such as that coming from a microphone for instance, but from a coded signal which changes as a function of the variations of this signal. At each change of state of the coded signal there corresponds a different excitation of the luminous sources and this in accordance with a predetermined sequence which is repeated.

A further purpose of the invention is to provide a code converter the function of which consists for a predetermined sequence of increasing the number of possible states which the coded signal may assume in such sequence.

DESCRIPTION OF THE PREFERRED EMBODIMENT

Figure 1:
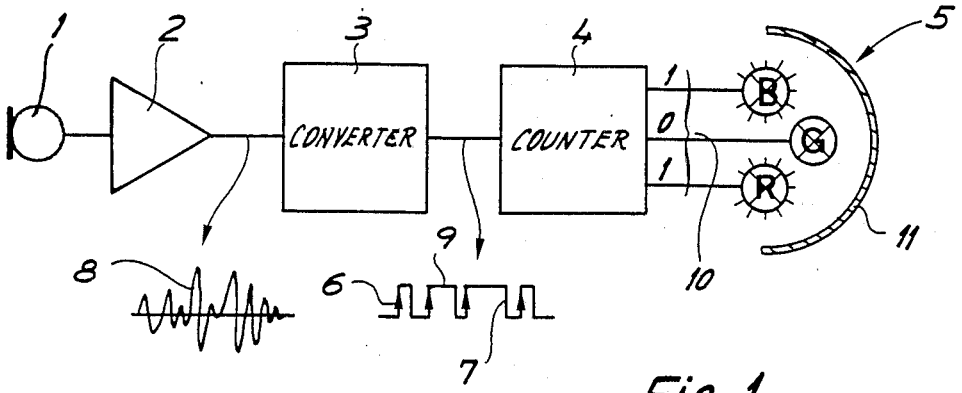
FIG. 1 is a schematic representation of the driving arrangement according to the invention.

FIG. 1 shows a light emitting element equipped with three luminous sources referenced B (blue), G (green)

and R (red). The colour gradation emitted by this element changes as a function of the variations of an analog electrical signal provided by a physical phenomenon detector here a microphone 1. Since the voltage picked up at the terminals of the microphone is low, it is amplified by amplifier 2 at the output of which is found a signal 8 of sufficient amplitude to be utilized in the driving arrangement according to the invention. This arrangement comprises initially a converter 3 which transforms the analog signal 8 into a sequence of pulses 9 of which the leading edges 6 and trailing edges 7 follow one another at a rhythm which depends on the variations of the analog signal 8. The driving arrangement according to the invention further comprises a counter 4 which utilizes the leading or trailing edges (here preferably the leading edges 6) of each of said pulses 9 to provide at its output a coded signal 10 the state of which changes each time that there is applied to counter 4 one of the leading or trailing edges of pulses 9. Each of the successive states present at the output of counter 4 gives rise to a predetermined state of excitation of the luminous sources. Thus, according to the example of FIG. 1, the state 1 0 1 of signal 10 drives lamps B and R while lamp G remains extinguished. If B and R radiate respectively the colour blue and red, the colour of the light emitting element 5 will be violet.

In the example of FIG. 1, three luminous sources are employed which is the most frequent case in order to arrive at a large range of different tints. It will however be noted that two sources suffice in order to obtain changes of tints according to whether one or the other of said sources is illuminated or whether they are illuminated together. The mixture of colours is obtained naturally if the observer is at a distance when considering the overall light emitting element. If such element is to be seen close up, there will be arranged between the observer and the luminous sources a translucent screen 11 which will obtain the mixture by addition.

Figure 2:
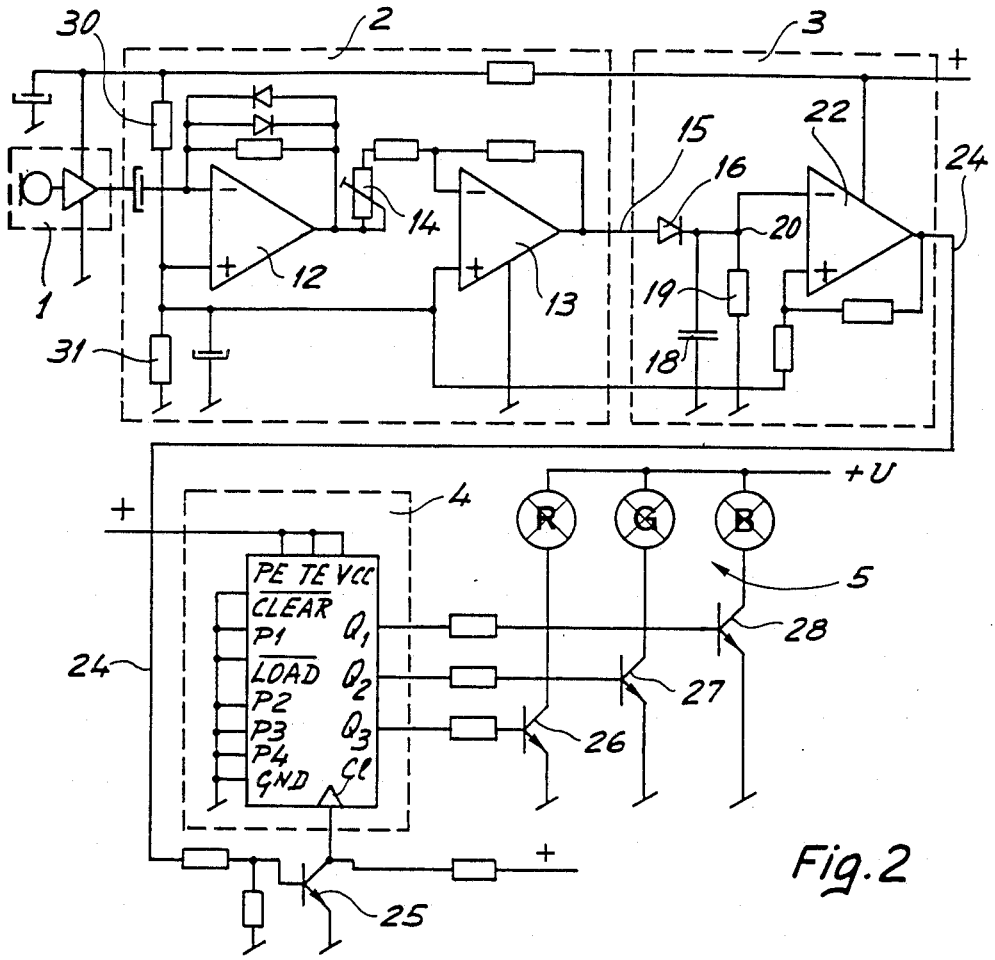
FIG. 2 is a detailed schematic diagram of the driving arrangement in accordance with a first form of the invention.

FIG. 2 is a detailed schematic of the driving arrangement of which the basic schematic has been explained above and according to a first form of execution. Here there will be found the various elements 1, 2, 3, 4 and 5 shown on FIG. 1 and which will now be explained in detail.

The physical phenomenon sensor 1 enables bringing a predetermined tint into correspondence with the magnitude of a physical value. Here the value in question is an acoustic or musical signal sensed by a microphone. This however could be another magnitude, for instance the angle of rotation of an axis, the displacement of a control lever, temperature, etc. The microphone employed is preferably of the electret type with its own preamplifier.

The electrical signals coming from microphone 1 are applied next to an amplifier 2 which includes two operational amplifiers 12 and 13 connected in cascade. A potentiometer 14 enables regulating the gain of amplifier 2. Block 2 is energized in direct current as are blocks 1, 3 and 4 moreover by a source not shown and through the lines marked +. At the output 15 of amplifier 2 an analog signal is picked up having the form of that shown as 8 on FIG. 1.

The signal present on line 15 is next applied to converter 3 the purpose of which is to convert said signal into a sequence of electrical pulses appearing on the output line 24 of said converter. In the method here applied this conversion is obtained in the following manner: in passing through diode 16 the analog signal has removed therefrom its negative phase. The positive phase remaining is shown referenced 17 on FIG. 3*a*. The thus rectified signal is applied next to an integrator formed by capacitor 18 and resistor 19 which results in the formation at point 20 of a new signal which is the envelope of the rectified analog signal that may be seen at 21 on FIG. 3*a*. Finally, the signal envelope 21 is applied to an operational amplifier 22 functioning as a comparator. Signal 21 is compared therein to a voltage threshold referenced 23 on fIG. 3*a* and determined by the divider formed by resistors 30 and 31 shown on FIG. 2. On the output line 24 of the comparator there will then be found the sequence of pulses which appears on FIG. 3*b*, the leading edge 6 of these pulses intervening each time that the signal envelope 21 exceeds the voltage of the threshold 23 and the trailing edge each time that the signal envelope falls below said threshold voltage.

The pulses of FIG. 3*b* are next applied to a counter 4 at its input Cl (clock) after having passed through the inverter 25. Counter 4 is of the three bit type and exhibits on its outputs $Q_1$, $Q_2$ and $Q_3$ $2^3=8$ successive different states. Each of these outputs controls a switch 26, 27, 28 of the semi-conductor type which in turn controls the energization of the corresponding luminous source R, G, B. The counter 4 changes state each time that a leading edge is applied to its input Cl while it is not responsive to the trailing edge of said control pulses. On the outputs $Q_1$, $Q_2$ and $Q_3$ of the counter there will be found successive situations illustrated by the following table, which gives likewise the sequence of lighting up of the luminous sources R, G, B responsive to the appearance of the leading edges at the input Cl of the counter:

| State | $Q_1$ | $Q_2$ | $Q_3$ | Colours |
|---|---|---|---|---|
| 1 | 0 | 0 | 0 | none |
| 2 | 1 | 0 | 0 | blue |
| 3 | 0 | 1 | 0 | green |
| 4 | 1 | 1 | 0 | blue + green = cyan |
| 5 | 0 | 0 | 1 | red |
| 6 | 1 | 0 | 1 | blue + red = violet |
| 7 | 0 | 1 | 1 | green + red = yellow |
| 8 | 1 | 1 | 1 | blue + green + red = white |

Then the sequence recommences. There will be found on FIG. 3 the state of the outputs $Q_1$, $Q_2$ and $Q_3$ for the three successive leading edges shown on FIG. 3*b* and at the bottom of FIG. 3 the colour combinations which result therefrom.

Figure 3:
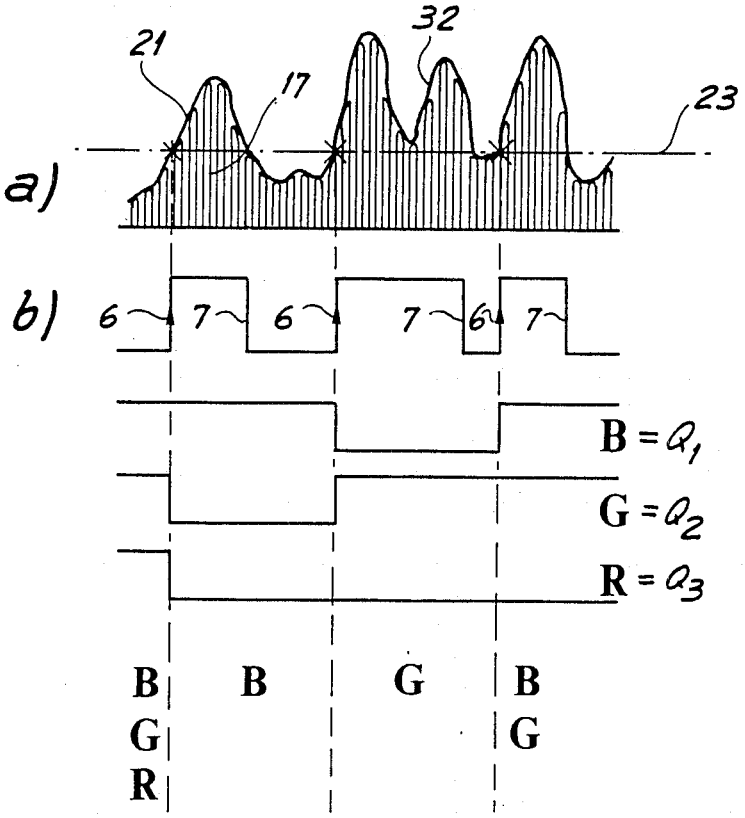
FIG. 3 is a diagram referring to FIG. 2.

An examination of FIG. 3 shows that the chosen value of the voltage threshold 23 is critical. If the musical intensity level is very high, it will be maintained above this threshold and there will be little or no colour change. On the contrary, in the case where the musical intensity level is low, the signal envelope may be confined below the threshold 23. To avoid at least partially this difficulty, it is possible to employ an amplifier 2 which will be equipped with an automatic gain control (AGC) in the place of the manual control provided by potentiometer 14. This arrangement however will not entirely resolve the problem since there could still be found sudden variations of volume which would not be taken into account although one would expect to have them change the colour of the light emitting element. This is the case for instance of the change of volume represented by the slope 32 of the signal of FIG. 3*a* which does not bring about any colour change.

Figure 4:
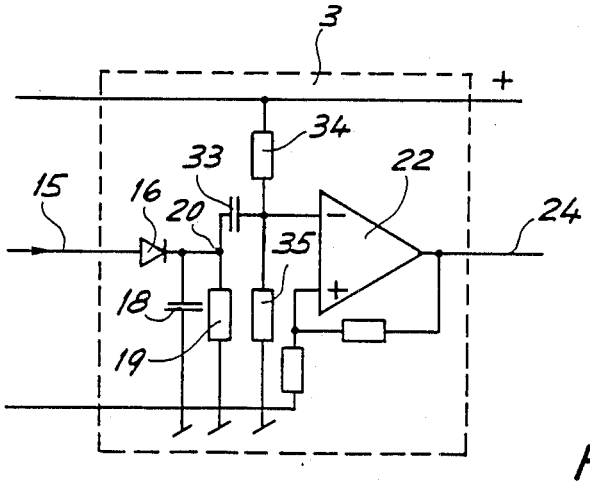
FIG. 4 is a partial schematic of the driving arrangement according to a second form of execution and which concerns a variant to the converter 3 shown on FIG. 2.
Figure 5:
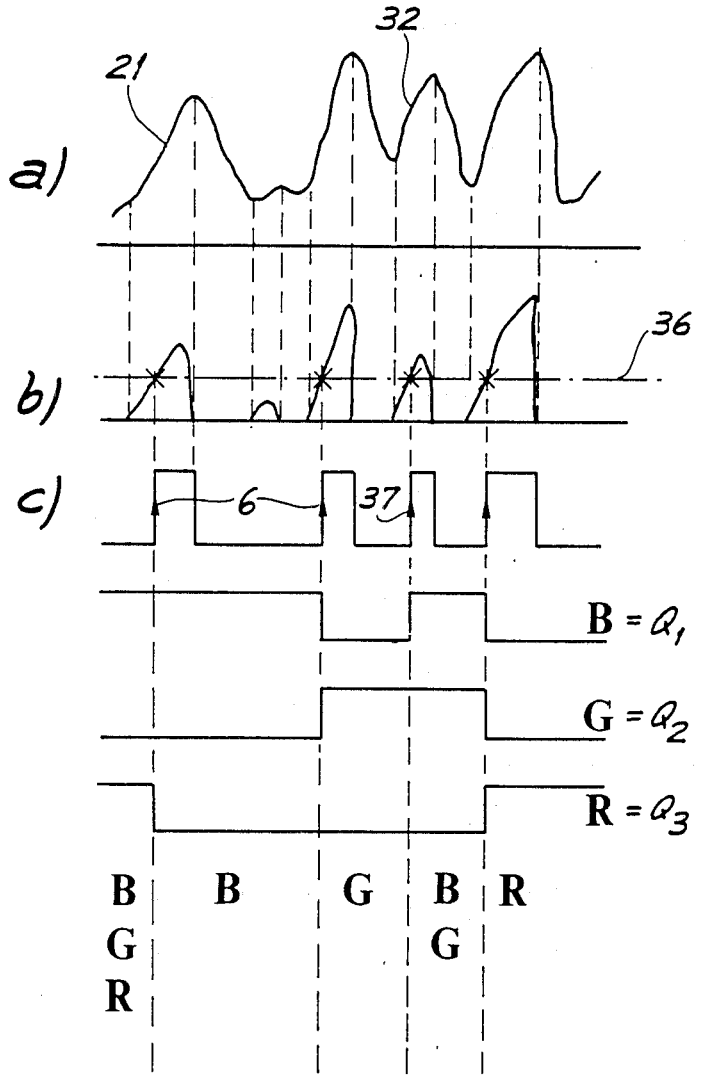
FIG. 5 is a diagram referring to the second form of execution.

To overcome this difficulty, one may provide a second form of execution of the invention which will be explained having reference to FIG. 4 which shows a modified converter 3, all the other blocks being similar to those discussed having reference to FIG. 2. Converter 3 of FIG. 4 comprises a differentiator arranged between the integrator 18, 19 and the comparator 22. This differentiator comprises capacitor 33 and two resistors 34 and 35. The signal envelope present at point 20 is applied to capacitor 33 of the differentiator. This system has as initial purpose to cause the signal envelope to be centered about a zero level and thence, if the value of the capacitor 33 is chosen to be sufficiently small with reference to the resistors 34 and 35, to have the comparator act on the slope of the signal envelope. Under these conditions each sudden change of the signal will cause the comparator to produce a signal at its output while a slow change will not change its state. This may be seen on FIG. 5. There has been shown on FIG. 5*a* the same signal envelope 21 as that shown on FIG. 3*a* and which is present at point 20 of FIG. 4. FIG. 5*b* shows the form of the differentiated signal such as it would appear following capacitor 33 and such as is applied to comparator 22. The differentiated signal is compared with the threshold voltage 36, which produces at the output of the comparator the series of pulses appearing at FIG. 5*c*. In their turn the leading edges 6 of the signal change the state of counter 4 which leads to a sequence of tints following the various successive states assumed by the outputs $Q_1$ $Q_2$ $Q_3$ of counter 4. FIG. 5 shows clearly that in this form of the invention the slope 32 of the signal of FIG. 5*a* gives rise to a leading edge referenced 37 on FIG. 5*c* and which brings about a colour change while this is not the case when the converter 3 is not provided with the differentiator. There will thus be found for the same signal envelope as that taken as an example in the first form of the invention a colour sequence which presents an additional state such as appears on FIG. 5 at the outputs $Q_1$, $Q_2$ and $Q_3$ of the counter outputs.

Figure 6:
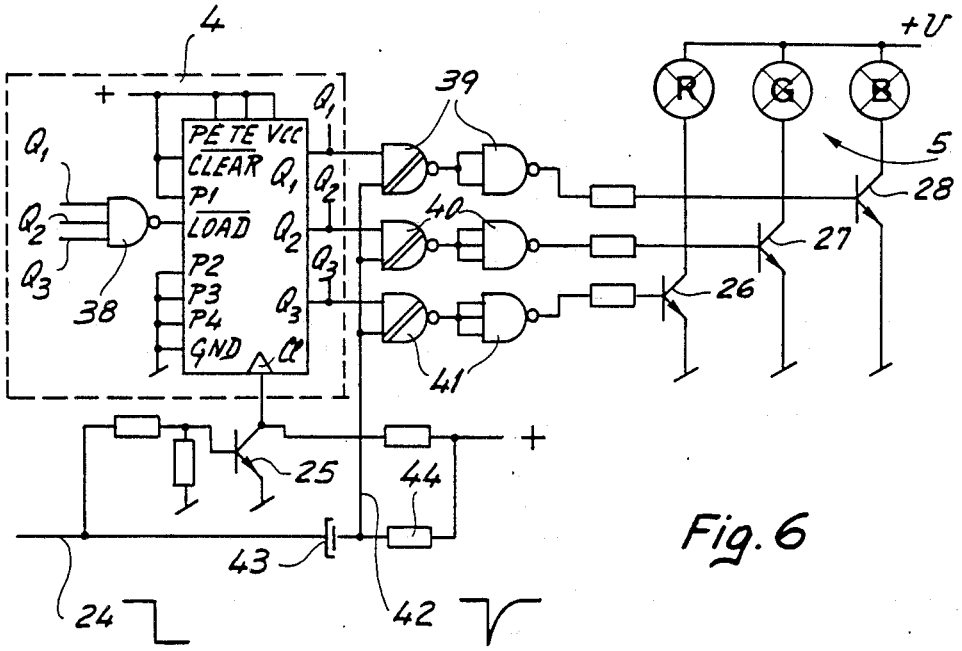
FIG. 6 is a partial schematic diagram of the driving arrangement according to a third form of the invention and which concerns on one hand a variant of the counter 4 and on the other hand the addition of supplementary circuitry interposed between the counter 4 and the luminous sources BGR.

FIG. 6 is a partial schematic diagram of the driving arrangement according to a third form of the invention. In this form on one hand the outputs $Q_1$, $Q_2$ and $Q_3$ of counter 4 are connected to a NAND gate 38 and, on the other hand, the same three outputs are connected to switches 28, 27 and 26 via gates 39, 40 and 41 respectively.

It will be noted that the output of gate 38 is connected to the input LOAD of the counter, that the input $P_1$ is additionally connected to the source while the inputs $P_2$ and $P_3$ are connected to earth. This combination has as a purpose to prevent the state 0 0 0 from arising at the output of the counter. Effectively, when signal 1 1 1 is present at the inputs of gate 38, a signal 0 will appear at the output of said gate, which has as result to preset the counter according to the state imposed on the inputs $P_1$, $P_2$ and $P_3$ when the next leading edge Cl arrives. Here the preselection is made on the value 1 0 0. Thus the state 0 0 0 which is found between state 1 1 1 and 1 0 0 (as may be seen on the table given above) is suppressed. This programming has as purpose to avoid a black state in the sequence which is thus reduced to 7 different states.

As is further shown by FIG. 6, gate means are arranged between the outputs $Q_1$, $Q_2$ and $Q_3$ of the counter and the luminous sources. This arrangement has as its purpose to prevent the application of the coded signal to the luminous sources for a predetermined lapse of time during a change of state of this signal. It has effectively been noted that a very short pause (black pause) between the passage from one colour to another gives a more remarkable impression of the passage than if the change was effected without a pause. The gates 39, 40 and 41 receive on their first inputs signals $Q_1$, $Q_2$ and $Q_3$ respectively and on the second inputs placed in parallel a signal 42 which is the differentiation of the trailing edge of the control pulse arriving via line 24. The differentiation is obtained by the RC formed by capacitor 43 and resistor 44. Elements 43 and 44 will be dimensioned in a manner to obtain preferably a pause on the order of 50 to 100 ms prior to the firing.

Figure 7:
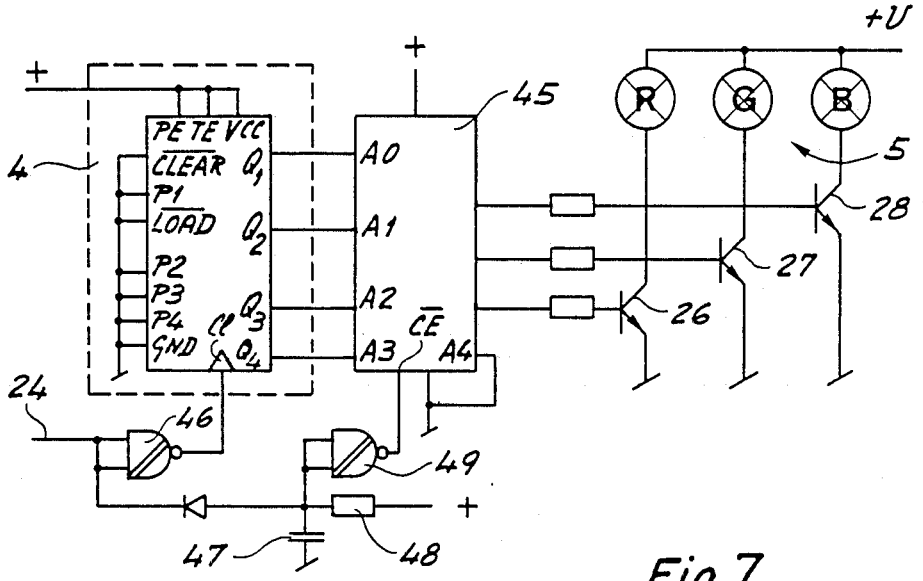
FIG. 7 is a partial schematic of the driving arrangement according to a fourth form of the invention and which concerns the addition of a code converting circuit interposed between the counter 4 and the luminous sources BGR.

FIG. 7 is a partial schematic drawing of the driving arrangement according to a fourth form of the invention. Here there is arranged between counter 4 and the luminous sources RGB a code converter 45. If the counter 4 is of the n bit type, it will exhibit at its output $2^n$ different successive states. By interposing between the n outputs Q of the counter and the three luminous sources a code converter 45 exhibiting n inputs and three outputs, there will be arranged at the output of said converter likewise $2^n$ successive different states, while the solutions given up to now permit only $2^3=8$ successive different states as has already been mentioned. In the case where n=4 (example of FIG. 7) there will be $2^4=16$ successive different states as is shown in the following table which is an example chosen among many others and where R=red, B=blue, G=green and W=white.

| State | $Q_1$ | $Q_2$ | $Q_3$ | $Q_4$ | Colour | State | $Q_1$ | $Q_2$ | $Q_3$ | $Q_4$ | Colour |
|---|---|---|---|---|---|---|---|---|---|---|---|
| 1 | 0 | 0 | 0 | 0 | W | 9 | 0 | 0 | 0 | 1 | RG |
| 2 | 1 | 0 | 0 | 0 | R | 10 | 1 | 0 | 0 | 1 | B |
| 3 | 0 | 1 | 0 | 0 | GB | 11 | 0 | 1 | 0 | 1 | RB |
| 4 | 1 | 1 | 0 | 0 | R | 12 | 1 | 1 | 0 | 1 | G |
| 5 | 0 | 0 | 1 | 0 | G | 13 | 0 | 0 | 1 | 1 | RG |
| 6 | 1 | 0 | 1 | 0 | BR | 14 | 1 | 0 | 1 | 1 | B |
| 7 | 0 | 1 | 1 | 0 | G | 15 | 0 | 1 | 1 | 1 | R |
| 8 | 1 | 1 | 1 | 0 | B | 16 | 1 | 1 | 1 | 1 | BG |

The beginning of this sequence of 16 different states shows that one has chosen opposed colours at the time of transitions in passing from one primary colour to its complement. This manner of arranging matters increases the contrast impression which brings a visual representation of greater contrast of the musical recording.

The code converter 45 employed is of the type of programmable memory generally known as PROM. The code converter may be programmed as desired and an example has just been given in the table hereinabove. It will be noted in particular that the state 0 0 0 no longer need be suppressed since it corresponds in the example given to a colour, in particular white (W) resulting from simultaneous driving of the three colours RGB.

In FIG. 7 there will be noted that the transistor inverter 25 shown on FIG. 2 has been replaced by a NAND gate 46 interposed between line 24 and the input C1 of counter 4

In the same manner, the arrangement shown in FIG. 6 to prevent the application of a coded signal to the luminous source RGB during a short time lapse is applied as well in the form of FIG. 7. The manner of obtaining this function is however simplified through the fact that the converter PROM 45 provides a single input CE. After having been differentiated by capacitor 47 and resistor 48, then inverted by gate 49, the trailing edge of the pulses presented on line 24 controls the input CE of memory 45.

The luminous sources RGB shown on the various figures may be of the incandescent type, each exhibiting a differently coloured bulb. The driving of these lamps is obtained by a D.C. source of value +U if the switches 26, 27 and 28 comprise simple transistors. If this voltage were to be an alternating current source, one would employ as a semi-conductor switch a system diac-trac well known from the state of the art.

These luminous sources could also be of the fluorescent tube type, the internal wall of each of them being covered by a different phosphor. In this case the starting voltage of the tubes is applied at the frequency of the network, said starting voltage being followed by a DC voltage for maintaining the arc.

It will be noted further that the absence of the black state as in the third and fourth forms of the invention (FIGS. 6 and 7) has as a consequence that the light emitting element always radiates at least one tint, whether this be at the start up of the driving arrangement during musical pauses or further during low levels of the musical signal.

Finally, it should be noted that the third and fourth forms of the invention are employed together with blocks 1, 2 and 3 shown on FIG. 1. In particular, block 3 may be that described in FIG. 2 or in FIG. 4.

What I claim is:

1. Driving arrangement for a light emitting element having at least two luminous sources each adapted to emit a different primary colour, the colour gradation emitted by said element changing as a function of an electrical analog signal provided by a physical phenomenon sensor, in particular a microphone, comprising a converter adapted to convert said analog signal into a sequence of electrical pulses the leading and trailing edges of which succeed one another at a rhythm which depends on the variations of said analog signal and a counter utilising the leading and trailing edges of each of said pulses to provide a coded signal at its output the state of which changes each time one of said leading or trailing edges is applied thereto, each of said states of said coded signal giving rise to a predetermined state of excitation of said luminous sources.

2. Driving arrangement as set forth in claim 1 wherein the converter includes an integrator adapted to furnish a signal which is the envelope of said analog signal and a comparator for comparing said signal envelope with a predetermined voltage threshold and providing at its output a pulse edge as soon as the amplitude of said signal envelope exceeds or falls below said predetermined voltage threshold.

3. Driving arrangement as set forth in claim 2 further including a differentiator arranged between the integrator and the comparator for differentiating the signal envelope, said comparator generating a pulse edge as soon as the differentiating signal envelope exceeds or falls below said predetermined voltage threshold.

4. Driving arrangement as set forth in claim 1 wherein the light emitting element is provided with three luminous sources each adapted to radiate a primary colour, the counter being of three bits so as to exhibit $2^3$ successive different states at its output and of which each of three outputs is coupled respectively to a luminous source.

5. Driving arrangement as set forth in claim 4 wherein the counter is programmed to suppress the state 0 0 0 at its outputs.

6. Driving arrangement as set forth in claim 4 comprising gating means between each of the counter outputs and the corresponding luminous sources to prevent the application of the coded signal to the luminous sources during a predetermined lapse of time at each change of state of said signal.

7. Driving arrangement as set forth in claim 1 wherein the light emitting element is provided with three luminous sources each adapted to radiate a primary colour, the counter being of n bits so as to exhibit $2^n$ successive different states at its output and including a code converter having n inputs and three outputs arranged between the n outputs of said counter and the three luminous sources.

8. Driving arrangement as set forth in claim 7 wherein the code converter comprises a programmable memory.

* * * * *